United States Patent [19]

Barnard

[11] Patent Number: 4,756,752

[45] Date of Patent: Jul. 12, 1988

[54] COMPACTED POWDER ARTICLE AND METHOD FOR MAKING SAME

[75] Inventor: Lewis J. Barnard, Bellaire, Mich.

[73] Assignee: Star Cutter Company, Farmington Hills, Mich.

[21] Appl. No.: 117,226

[22] Filed: Nov. 4, 1987

[51] Int. Cl.[4] ..... C22C 29/00

[52] U.S. Cl. ..... 25/230; 75/228; 75/235; 75/244; 264/65; 264/125; 264/570; 419/13; 419/19; 419/38; 419/49; 419/51

[58] Field of Search ..... 75/230, 235, 244, 228; 264/65, 125, 570; 419/13, 19, 38, 49, 51

[56] References Cited

U.S. PATENT DOCUMENTS

| | | | |
|---|---|---|---|
| 4,428,906 | 1/1984 | Rozmus | 419/49 |
| 4,547,337 | 10/1985 | Rozmus | 419/49 |
| 4,568,516 | 2/1986 | Adlerborn et al. | 419/49 |
| 4,601,877 | 7/1986 | Fujii et al. | 419/49 |
| 4,656,002 | 4/1987 | Lizenby et al. | 419/49 |

*Primary Examiner*—Stephen J. Lechert, Jr.
*Attorney, Agent, or Firm*—Harness, Dickey & Pierce

[57] ABSTRACT

A method for forming a high density body from a powder material of metallic and non-metallic compositions and combinations thereof comprising confining a quantity of the powder material in a flexible mold structure, subjecting the powder material in the mold structure to a predetermined pressure along one axis while confining the material against movement in directions normal to the axis so as to form a compact body of the powder material and subsequently heating the compact body to a predetermined temperature so as to further compact the body. A quantity of glass is heated so that it will flow and transmit pressure following which the heated body is immersed in the heated glass and the flowable glass is subjected to a pressure high enough to further compact the body. The resulting densified body is uniformly compressed in the directions of three mutually perpendicular axes extending through the body. The apparatus for forming the body includes a tubular member formed of flexible material which is compressible in an axial direction and expandable inwardly in a radial direction so as to densify the powder material contained therein as a result of conventional piston and cylinder action in which the tubular member is contained within the cylinder and subjected to the action of the piston on one end.

8 Claims, 3 Drawing Sheets

COMPACTED POWDER ARTICLE AND METHOD FOR MAKING SAME

BACKGROUND OF THE INVENTION

This invention relates generally to forming a high density body from a powder material and more particularly to the forming of fully dense high speed steel bodies from metal alloyed powders and forming dense fully compacted bodies from ceramic powders. Thus the invention relates to forming a high density body from a powder material of metallic and non-metallic compositions and combinations thereof.

It is known to form fully dense high speed steel alloy bodies from hot worked billets of the steel which have been formed from the alloyed powder. Such a product is shown in U.S. Pat. No. 4,576,642 dated Mar. 18, 1986. It is also well known to anneal and cold compact to shape water atomized powders and then vacuum sinter the preformed powders to high density. U.S. Pat. No. 4,428,906 shows encapsulated preform bodies cast into a mold comprised of a pressure transmitting medium which consists of a rigid interconnected ceramic skeleton structure and a fluidizing glass. In such cases, the bodies must be encapsulated to prevent the binders and other volatile components of the ceramic material from contaminating the bodies. Also, U.S. Pat. No. 4,656,002 is a further illustration of the use of molten glass and the ceramic skeleton for consolidating a dense body of powder material of metallic or non-metallic compositions.

However, none of the prior art utilizes heat and pressure directly on the preform product and in a self-encapsulating environment to produce a high density body from a powder material of metallic and non-metallic compositions and combinations thereof which is uniform in three mutually perpendicular planes and which exhibit improved properties of machineability, and long service life.

Furthermore, in the high density bodies formed pursuant to prior art processes, the sulfides, such as manganese sulfide, always end up in a form approaching stringers extending lengthwise of the bodies. In the articles formed according to this invention, the sulfide particles are uniformly dispersed as small roundish pieces that are not oriented in any particular planes. The result is articles with improved machinability and grindability qualities.

SUMMARY OF THE INVENTION

In the method of this invention, a high density body is formed from a powder material of metallic and non-metallic compositions and combinations thereof by confining a quantity of the powder material in a flexible mold structure, subjecting the powder material to a predetermined pressure along one axis while confining the material against movement in directions normal to that axis so as to form a compacted body of the powdered material.

The thus compacted body is then heated to a predetermined temperature concurrently with melting a quantity of glass and heating the resulting fluidized glass to a temperature at which the viscosity of the glass will enable the glass to function as an effective pressure transmitting medium. The heated body is then immersed in the heated glass and the glass is subjected to a pressure high enough to further compact the body, which is thus subjected to a compacting pressure which is uniform in three mutually perpendicular planes. The resulting body is thus of equal strength in all three of the planes in which it has been compacted. This invention is thus advantageous in that it avoids the necessity to built a supporting or encapsulating structure for a powder body each time such a body is to be consolidated.

The high density body, in one form of the invention, is formed from a steel alloy powder containing one or more metal carbides selected from the group consisting of tungsten, vanadium, molybdenum, chromium, cobalt and possibly others, and the body contains a uniform dispersion of sulfide particles which are uniformly arranged with respect to the three mutually perpendicular axes.

The preferred apparatus for practicing the invention includes at least one tubular mold member formed of a flexible material, such as a urethane rubber, a product made by Trexler Rubber Company of Revia, Ohio, and adapted to contain the powder material. The outer circumferential surface of the tubular member is supported against movement in a radially outwardly direction by the cylinder in a conventional piston and cylinder assembly. A piston is then used to apply force to opposite ends of the mold member for compressing the mold in an axial direction which in turn results in the transmission of pressure to the powder resulting in compressing the powder in both axial and radial directions. During such compression, a sealing ring of generally triangular cross section in shape is mounted on each end of the mold for engagement with the piston so that in response to movement of the piston and the elastic expansion of the confining mold member wall, the sealing rings are caused to be moved radially outwardly into firm engagement with the cylinder wall so that they continuously prevent extrusion of the softer material in the mold around the piston.

The piston and cylinder assembly is then used to subject the heated glass to the desired pressure, around 70,000 psi, and this pressure is uniformly transmitted to the heated body of compacted powder that is immersed in the glass. During the movement of the piston within the cylinder,the glass that is in intimate contact with the cooler cylinder, and piston is cooled, to thus increase its viscosity and, as a result, the more viscous glass acts as a seal to prevent escape of the heated glass around the piston during the application of pressure to the heated compacted body within the heated glass.

The result is a high density body of powder material which exhibits improved characteritics when shaped into structural products and used in industrial environments.

Further objects, features and advantages of the invention will become apparent from a consideration of the following description when taken in connection with the accompanying drawings in which:

Figure 1:
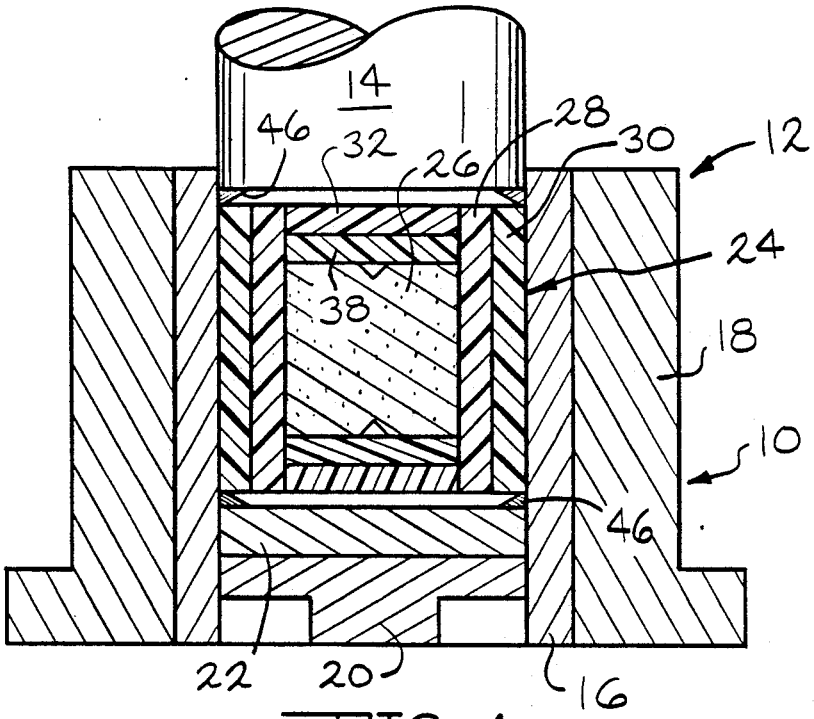
FIG. 1 is a vertical sectional view of the apparatus of this invention illustrating the apparatus in use to form a preform body of compacted powder material.

With reference to the drawing, the apparatus of this invention, indicated generally at 10 is illustrated in FIG. 1 as including a conventional piston and cylinder assembly 12 consisting of a downwardly movable piston 14 mounted within an inner tubular cylinder member 16 which is supported in a frame 18. Positioned within the cylinder 16 is a base 20 which supports a lower plate 22 on which an enclosure 24 for the powder material 26 to be compressed is supported. The enclosure 24 includes a pair of relatively telescoped concentric tubular mold members 28 and 30 which are formed of a flexible material such as urethane rubber. Outer rubber disks 32 and 34, also formed of urethane rubber are positioned at the upper and lower ends of the tubular members 28 and 30 at positions within the inner member 28 so as to support the upper and lower ends of the powder body 36 that is formed within the enclosure 24. Inner disks 38 and 40 are formed with centers 42 and 44. The purpose of the centers 42 and 44 is to form cavities 43 and 45 in the end surfaces of the body 36 to enable the body 36 to be mounted in a lathe or the like for machining purposes following densification.

Upper and lower metal seal rings 46 are mounted on the ends of the outer tubular member 30, as shown in FIG. 1. Each seal ring 46 is of a size such that its outer surface 47 engages the inner surface of the cylinder 16. The inner surface 49 of each ring 46 is inclined so that the reaction forces of the mold member 30 on the rings 46 during downward movement of piston 14 will have a radially outwardly directed component that expands the ring 46 so as to maintain the outer surface 47 in firm engagement with the cylinder 16. The rings 46 are formed of a high strength steel of moderate hardness which expands but does not exceed its elastic limit.

Figure 2:
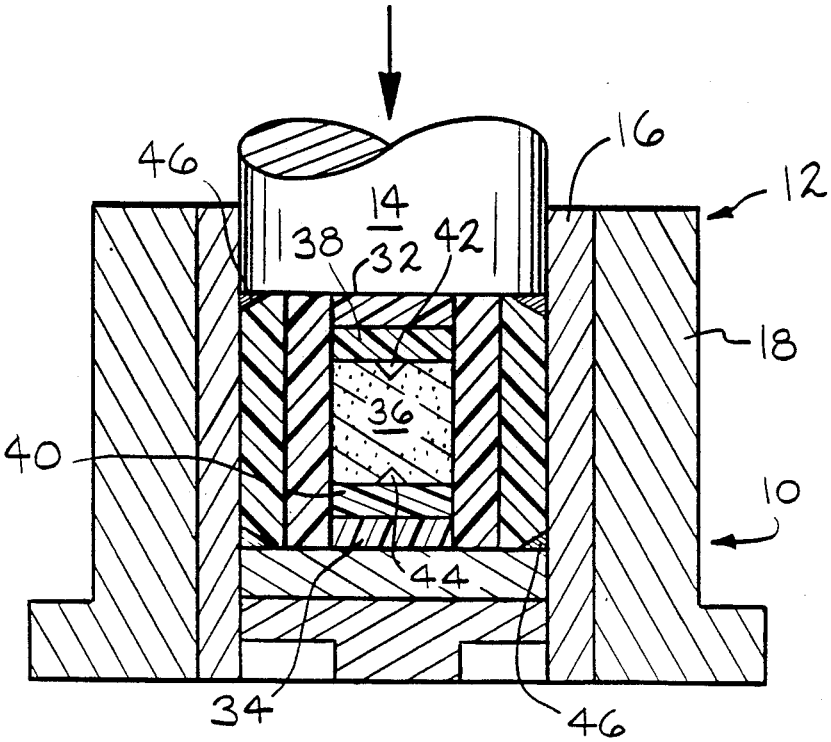
FIG. 2 is a vertical sectional view of the apparatus shown in FIG. 1, illustrating the apparatus in a position in which it has compacted the powder material to form the desired densified preform.
Figure 3:
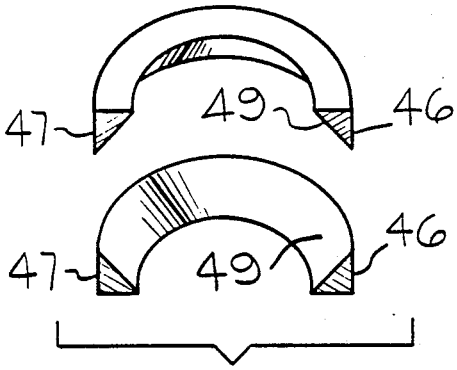
FIG. 3 is a perspective view of the sealing rings used in the apparatus illustrated in FIGS. 1 and 2, showing each ring cut in half to show the cross sectional shape of the rings.

As a result, during movement of the piston 14 downwardly from its FIG. 1 position to its FIG. 2 position, the force of the piston on the seal rings 46 maintains the outer surfaces 47 of the seal rings 46 in constant engagement with the inner surface of the cylinder 16 so as to prevent material in the tubular member 30 from extruding past the piston 14.

In a preferred embodiment of the invention, the force F to which the piston 14 is subjected in FIG. 2 is adequate to subject a powder 26 that forms the body 36 to a pressure of about 70,000 psi.

Figure 4:
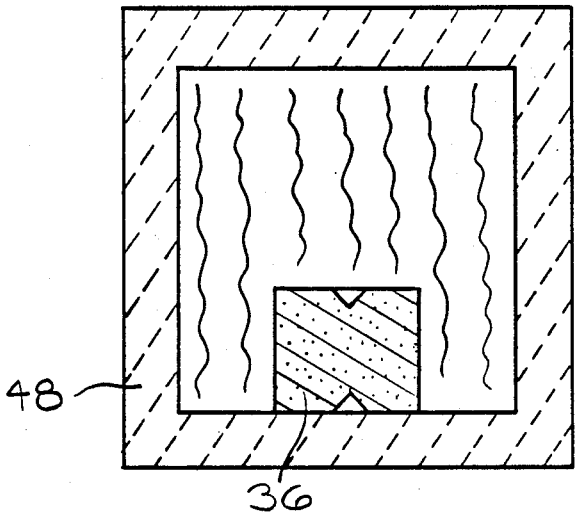
FIG. 4 is a vertical sectional view illustrating a furnace in which the densified preform from FIG. 2 has been placed in order to subject it to a high heating temperature.
Figure 7:
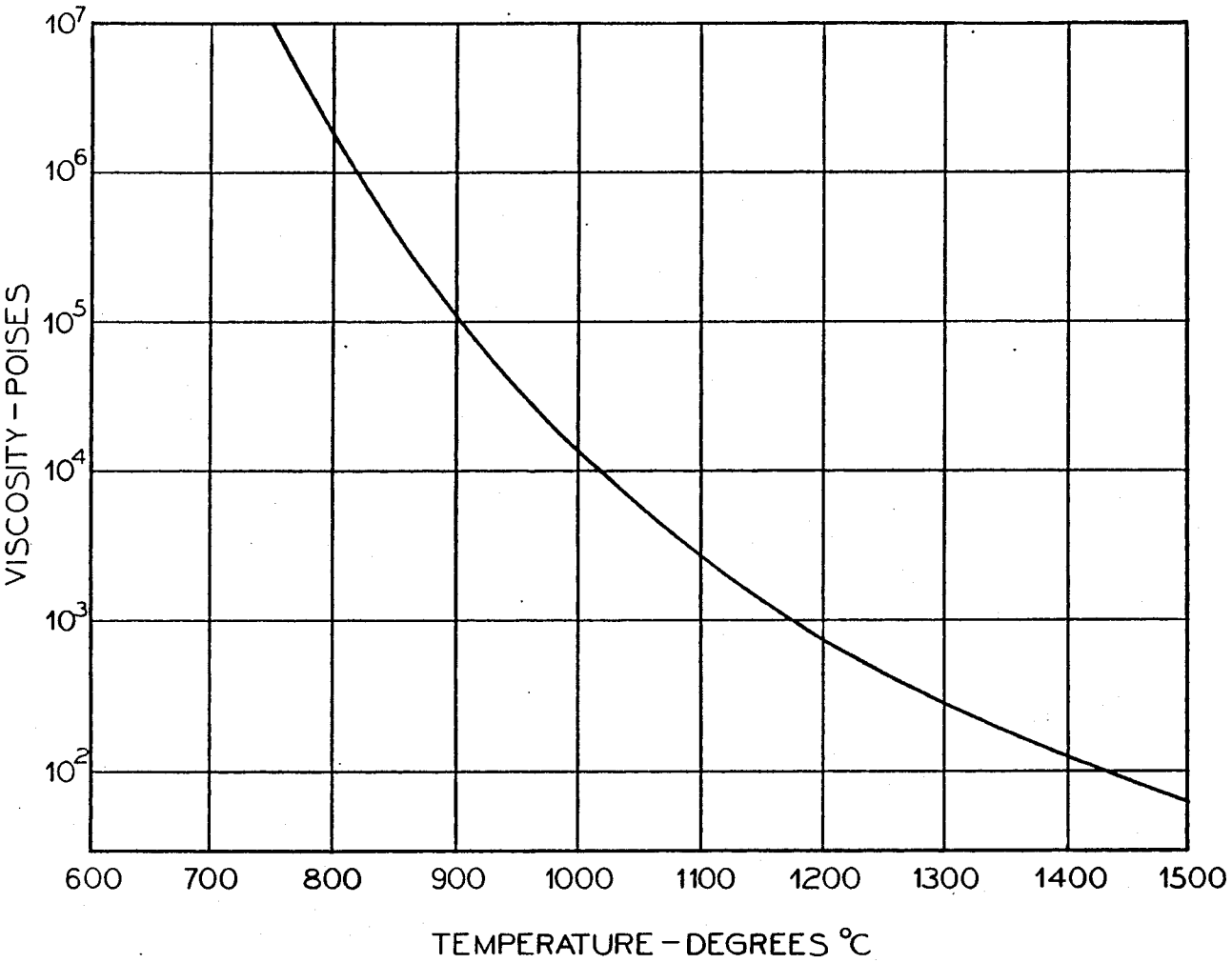
FIG. 7 is a graph illustrating the relationship between viscosity and temperature in a soda lime glass suitable for use as the heated glass illustrated in FIG. 5 for performing the final compacting step on the high density body of powder material.

The resulting compacted body 36 is then removed from the apparatus 10 and placed in a furnace 48, as shown in FIG. 4. The body 36 in the furnace 48 is subjected to a temperature of about 1,150° C. in a protective atmosphere. In the case of tool steel, the atmosphere is hydrogen. In the case of a ceramic, such as tin oxide, the temperature is 1,450° C. and the atmosphere is air. This heating step, illustrated in FIG. 4, is for the purpose of preparing the preform body 36 for further densification. Concurrently with heating of the preform body 36 to the 1,150° C. temperature, glass is heated to a temperature high enough to enable the glass to flow and transmit pressure to the body 36 and without taking appreciable heat from the body 36 during consolidation of the body. A glass is selected that has desirable viscosity and temperature characteristics; ie, gradual changes in viscosity with temperature changes. As illustrated in FIG. 7, a glass is selected which when heated to 1,150° C. has a viscosity, measured in poises, of about $10^3$ as shown in FIG. 7. Glass at this viscosity can be subjected to a pressure which will in turn be transmitted to the preform body to further densify the body.

Figure 5:
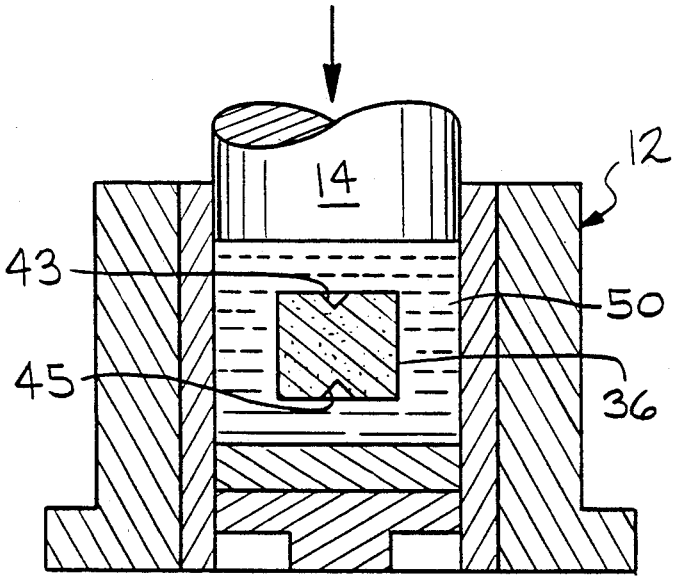
FIG. 5 is a vertical sectional view showing the heated and densified body of FIG. 4 immersed in molten glass and being subjected to a final uniform compacting pressure.
Figure 5A:
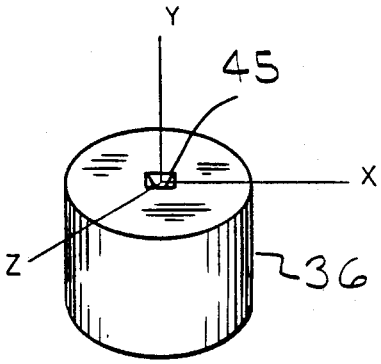
FIG. 5A is a perspective view of the densified body.
Figure 6A:
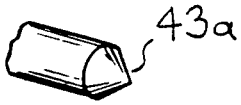
FIGS. 6A and 6B are fragmentary perspective views of the ends of the machine elements which support and drive the densified body during the machining step illustrated in FIG. 6.
Figure 6B:
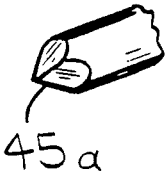
Figure 6:
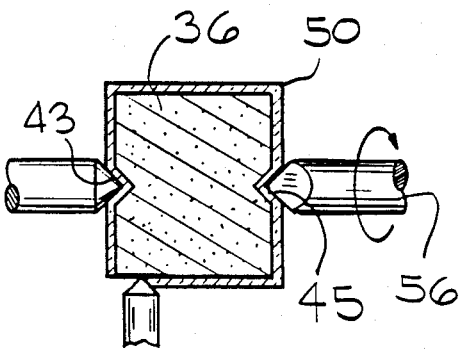
FIG. 6 is a view illustrating the machining of the densified body from FIG. 5 in order to remove glass which may have impregnated the outer surface of the body.

As illustrated in FIG. 5, the piston and cylinder assembly 12 is then filled with heated glass 50 having the above characteristics and the densified preform body 36 is immersed in the molten glass. The glass 50 is positioned in the cylinder 16 at a position on the support 22 and is engaged on the top surface by the piston 14. The piston 14 is then moved downwardly to apply a pressure of about 70,000 psi to the glass 50. Because of the position of the preform body 36 within the fluidized glass 50, the body 36 is subjected to a uniform pressure in directions both radially and axially to the body 36 to uniformly densify the body 36 along three mutually perpendicular axes indicated in FIG. 5A as axes X, Y and Z.

The result is a densified structure in which the strength of the structure is uniform along the axes X, Y and Z, thereby providing a body which is capable of use in a variety of structural environment in which strength of the body is desired along any one or more of these axes.

As pointed out above, the powder used to made the body 36 can be a metallic powder, such as a steel alloy powder capable of use in making metal working tools such as hobs. The powder can also be a non-metallic composition such as a ceramic or refractory powder, or the powder can be a combination of the metallic and non-metallic powders.

Although a pair of mold tubes 28 and 30 are shown, it is to be understood that more or less such tubes can be used in the practice of this invention.

After the body 36 is removed from the heated glass 50, it is placed in a conventional lathe 52 and a tool 54 is used to remove any glass that may have impregnated the surface of the body 36. The installation of the body 36 in the lathe is facilitated by the cavities 43 and 45 formed in the end surfaces of the body 36. The cavity 45 is rectangular in cross section which is complementary to the shape of a projection 45*a* on the lathe drive shaft 56. The cavity 43 is circular in cross section so that it is complementary to the shape of the supporting center 43*a*. This aids in simplicity of finish michining of the body 36.

In the process of this invention, there is better control of the material during the process so that the physical qualities of the resulting product can be more uniformly maintained. As a result, the product has much better machineability characteristics. The process can also be used for ceramic materials such as SIALON, tin oxide, zirconium, and silicon nitride powders. These refractory powders, when densified and compacted according to the above-described process produce bodies which also have improved physical properties and yield the desired physical characteristics when processed to form a variety of commercial structures.

I claim:

1. The method for forming a high density body from a powder material of metallic and non-metallic compositions and combinations thereof comprising:

a. confining a quantity of the powder material in a flexible mold structure, b. subjecting the mold structure to a force along one axis while confining the mold structure in directions perpendicular to said one axis to thereby subject said powder material to a predetermined pressure along said axis in directions normal to said axis so as to form a compacted body of said powder material, c. heating the compacted body to a predetermined temperature, d. heating a quantity of glass to a viscosity at which it will transmit pressure and heating the resulting flowable glass to at least said predetermined temperature, e. immersing the heated body in said heated glass, and f. subjecting said heated glass to a pressure high enough to further compact said body.

2. The method according to claim 1 wherein said one axis is substantially vertical and said directions normal to said axis extend generally outwardly in horizontal directions so that said body is compacted in both vertical and horizontal directions.

3. The method according to claim 1 wherein said predetermined force creates a pressure of about 70,000 psi and said predetermined temperature is a temperature of about 1,150° C.

4. The method according to claim 3 wherein the pressure to which said heated glass is subjected is a pressure of about 70,000 psi.

5. A densified body of powder material of metallic and non-metallic compositions and combinations thereof produced by the method of claim 1.

6. A densified body of powder material of metallic and non-metallic compositions and combinations thereof produced by the method of claim 2.

7. A densified body of powder material of metallic and non-metallic compositions and combinations thereof produced by the method of claim 3.

8. A densified body of powder material of metallic compositions and non-metallic compositions and combinations thereof produced by the method of claim 4.

* * * * *